US009541868B2

(12) United States Patent
Mizuno

(10) Patent No.: US 9,541,868 B2
(45) Date of Patent: Jan. 10, 2017

(54) IMAGE FORMING APPARATUS AND IMAGE FORMING METHOD

(71) Applicants: KABUSHIKI KAISHA TOSHIBA, Tokyo (JP); TOSHIBA TEC KABUSHIKI KAISHA, Tokyo (JP)

(72) Inventor: Masanaka Mizuno, Mishima Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/978,788

(22) Filed: Dec. 22, 2015

(65) Prior Publication Data

US 2016/0109833 A1 Apr. 21, 2016

Related U.S. Application Data

(63) Continuation of application No. 14/506,171, filed on Oct. 3, 2014, now Pat. No. 9,256,173.

(30) Foreign Application Priority Data

Jan. 29, 2014 (JP) ..... 2014-014360

(51) Int. Cl.
*G03G 15/20* (2006.01)
*G03G 15/00* (2006.01)

(52) U.S. Cl.
CPC ..... *G03G 15/205* (2013.01); *G03G 15/2046* (2013.01); *G03G 15/2003* (2013.01); *G03G 15/2064* (2013.01); *G03G 15/2078* (2013.01); *G03G 15/2082* (2013.01); *G03G 15/5004* (2013.01); *G03G 2215/2016* (2013.01); *G03G 2215/2032* (2013.01)

(58) Field of Classification Search
CPC ..... G03G 15/20
USPC ..... 399/70
See application file for complete search history.

(56) References Cited

U.S. PATENT DOCUMENTS

| | | | | |
|---|---|---|---|---|
| 8,660,450 | B2 * | 2/2014 | Furuyama | G03G 15/2039 399/68 |
| 8,831,460 | B2 * | 9/2014 | Hamada | H04N 1/00891 399/37 |
| 9,342,001 | B2 * | 5/2016 | Ishikura | G03G 15/205 |
| 2005/0047279 | A1 * | 3/2005 | Ito | G04G 15/006 368/10 |
| 2006/0222395 | A1 * | 10/2006 | Yoda | G03G 15/205 399/69 |

(Continued)

FOREIGN PATENT DOCUMENTS

| | | |
|---|---|---|
| JP | 2006-267941 | 10/2006 |
| JP | 2009-031637 | 2/2009 |

*Primary Examiner* — David Gray
*Assistant Examiner* — Kevin Butler
(74) *Attorney, Agent, or Firm* — Patterson & Sheridan, LLP

(57) ABSTRACT

According to one embodiment, an image forming apparatus for forming an image on a recording medium includes a fixing member that fixes a toner image to the recording medium. A heating unit heats the fixing member. A control unit receives a print job, the print job indicating a print mode and at least one job condition. The control unit determines a ready temperature based on the print mode and the at least one job condition. The control unit controls a heating operation of the heating unit based on the determined ready temperature.

13 Claims, 10 Drawing Sheets

(56) References Cited

U.S. PATENT DOCUMENTS

| | | | | |
|---|---|---|---|---|
| 2011/0311257 | A1* | 12/2011 | Nozawa | G03G 15/2039 399/70 |
| 2013/0202320 | A1* | 8/2013 | Hase | G03G 15/2039 399/44 |
| 2014/0133879 | A1* | 5/2014 | Seshita | G03G 15/205 399/70 |
| 2014/0241747 | A1* | 8/2014 | Ito | G03G 15/205 399/68 |
| 2014/0255054 | A1* | 9/2014 | Katayama | G03G 15/2039 399/69 |
| 2014/0255055 | A1* | 9/2014 | Katayama | G06K 15/14 399/69 |
| 2014/0314436 | A1* | 10/2014 | Shibahara | G03G 15/205 399/68 |
| 2015/0037055 | A1* | 2/2015 | Kitagawa | G03G 15/2046 399/68 |
| 2015/0212464 | A1* | 7/2015 | Mizuno | G03G 15/205 399/69 |

* cited by examiner

| TONER MODE | FIXING REFERENCE TEMPERATURE | FIXING LOWER LIMIT TEMPERATURE |
|---|---|---|
| COLOR MODE | 160℃ | 150℃ |
| MONOCHROME MODE | 140℃ | 130℃ |

Fig.4

TABLE 101a

| NUMBER OF PRINTING SHEETS | TONER MODE | |
|---|---|---|
| | COLOR MODE | MONOCHROME MODE |
| 1 | 150℃ | 130℃ |
| 2– 5 | 152℃ | 132℃ |
| 6– 10 | 155℃ | 135℃ |
| NOT LESS THAN 11 | 160℃ | 140℃ |

Fig.5

TABLE 101a

| TYPE OF SHEET | | TONER MODE | |
|---|---|---|---|
| PLAIN SHEET | THICK SHEET | COLOR MODE | MONOCHROME MODE |
| A4 | | 150℃ | 130℃ |
| A3 | | 152℃ | 132℃ |
| | A4 | 155℃ | 135℃ |
| | A3 | 160℃ | 140℃ |

Fig.9

IMAGE FORMING APPARATUS AND IMAGE FORMING METHOD

CROSS-REFERENCE TO RELATED APPLICATIONS

This application is a continuation of U.S. patent application Ser. No. 14/506,171, filed on Oct. 3, 2014, which is based upon and claims the benefit of priority from Japanese Patent Application No. 2014-14360, filed on Jan. 29, 2014, the entire contents of which are incorporated herein by reference.

FIELD

The embodiments described herein relate generally to an image forming apparatus and an image forming method that form an image by fixing a toner image to a recording medium.

BACKGROUND

Image forming apparatuses having a fixing device heating and fixing a toner image to a recording medium, for instance a sheet have been known. A ready temperature of the fixing device is set constantly and by a margin. Thus, even on a printing job to which a maximum load is applied, the fixing device maintains good fixing performance up to the final print. However, a quantity of heat at which the fixing device requires actually differs depending on job conditions such as a type of toner, the number of printing sheets, and a sheet size. For this reason, when the image forming apparatus carries out a job having a low load applied to the fixing device, the ready temperature may be excessive to impede energy saving. Further, when returning from a sleep state (power saving state) to a ready state, the image forming apparatus takes a long time to do a warmup for raising a heating temperature of the fixing device to a higher ready temperature than necessary.

BRIEF DESCRIPTION OF THE DRAWINGS

FIG. 4 is a view illustrating storage contents of a fixing reference temperature and a fixing lower limit temperature which the image forming apparatus according to the first embodiment stores.

FIG. 5 is a view illustrating storage contents of ready temperatures which the image forming apparatus according to the first embodiment stores in response to job conditions.

FIG. 9 is a view illustrating storage contents of ready temperatures which an image forming apparatus according to a second embodiment stores in response to job conditions.

DETAILED DESCRIPTION

Figure 1:
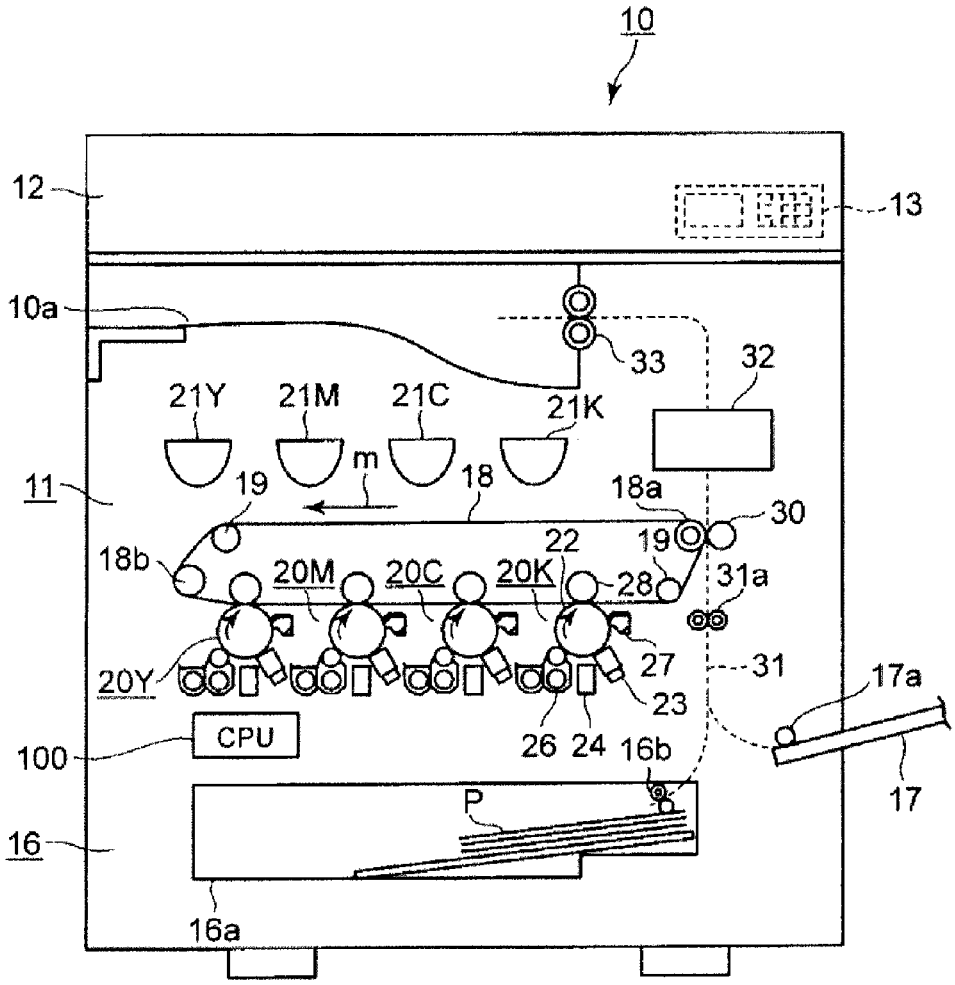
FIG. 1 is a cross-sectional view illustrating major parts of an image forming apparatus according to a first embodiment.

According to one embodiment, an image forming apparatus has a fixing member, a heating unit, and a control unit. The fixing member fixes a toner image formed on a recording medium to the recording medium. The heating unit heats the fixing member. The control unit controls a heating operation of the heating unit based on a ready temperature corresponding to job information input by a user.

Hereinafter, additional embodiments will be described with reference to the drawings. In the drawings, the same reference numerals indicate the same or similar portions.

The image forming apparatus of a first embodiment will be described with reference to FIGS. 1 to 8. FIG. 1 is a cross-sectional view illustrating a multi-function peripheral (MFP) 10 which is an example of the image forming apparatus of the first embodiment and by which a color image can be formed. The MFP 10 is controlled in any of a sleep state, a ready state, and a job fulfillment state by a central processing unit (CPU) to be described below. The sleep state is, for instance, a state of the MFP 10 controlled to inhibit power from being supplied to each part of the MFP 10 relative to the other states. In other words, the sleep state is a power saving state of the MFP 10. In the sleep state, a temperature of the fixing member to be described below is held at a given temperature lower than a ready temperature to be described below. The ready state is, for instance, a state of the MFP 10 controlled to hold the temperature of the fixing member at the ready temperature and to be able to immediately respond to input of printing job information from a user. When the input of the job information from the user is not present in the ready state in spite of the lapse of, for instance, predetermined time or more even, the MFP 10 makes up the transition from the ready state to the sleep state. When the job information is input in the sleep state by the user, the MFP 10 returns from the sleep state to the ready state. When the MFP 10 returns from the sleep state to the ready state, the MFP 10 performs a warmup for raising the temperature of the fixing member to the ready temperature. The job fulfillment state is a state of the MFP 10 controlled such that jobs are carried out based on job conditions included in the job information input from the user. As illustrated in FIG. 1, the MFP 10 has a printer device 11 that is an image forming unit, a scanner device 12, and a control panel 13. The MFP 10 has the CPU 100 that is a control unit for controlling the entirety of the MFP 10.

The printer device 11 has an intermediate transfer belt 18, four sets of image forming stations 20Y, 20M, 20C and 20K, and replenishment cartridges 21Y, 21M, 21C and 21K. The intermediate transfer belt 18 is provided to be rotatable in a direction of an arrow m. The four sets of image forming stations 20Y, 20M, 20C and 20K are, in FIG. 1, provided along a lower side of the intermediate transfer belt 18. The image forming stations 20Y, 20M, 20C and 20K have a configuration to be described below for forming images of respective colors of Y (yellow), M (magenta), C (cyan), and K (black). The replenishment cartridges 21Y, 21M, 21C and 21K are, in FIG. 1, provided above the image forming stations 20Y, 20M, 20C and 20K so as to be able to be removed by a user.

The four sets of image forming stations 20Y, 20M, 20C and 20K each have a photosensitive drum 22, an electrification charger 23, an exposure scanning head 24, a developing device 26, and a photoreceptor cleaner 27. The photosensitive drum 22 is provided to be rotatable in an arrow direction illustrated in FIG. 1. The electrification charger 23, the exposure scanning head 24, the developing device 26, and the photoreceptor cleaner 27 are disposed around the photosensitive drum 22 in this order. The electrification charger 23 uniformly charges the photosensitive drum 22. The exposure scanning head 24 exposes the photosensitive drum 22. To be specific, the exposure scanning head 24 applies light, which is modulated based on image data obtained from the scanner device 12, to the charged photosensitive drum 22. Further, the exposure scanning head 24 applies light, which is modulated based on image data obtained from the outside via a network, to the charged photosensitive drum 22. The exposure scanning head 24 forms an electrostatic latent image corresponding to the image data on the photosensitive drum 22 by exposing the photosensitive drum 22. The developing devices 26 of the image forming stations 20Y, 20M, 20C and 20K contain two-component developers containing toners of Y, M, C, and K and carriers, respectively. The developing device 26 develops the electrostatic latent image by supplying the toner to the photosensitive drum 22. The developing device 26 forms a toner image on the photosensitive drum 22 by developing the electrostatic latent image. The replenishment cartridges 21Y, 21M, 21C and 21K contain the toners of Y, M, C, and K replenished into the developing devices 26, respectively, when the toners contained in the developing devices 26 are reduced. As the toner, for instance, erasable toner may be used, or inerasable toner may be used. The erasable toner is, for instance, color erasable toner.

The color erasable toner is toner which a color can be erased, for instance, by heating to a given color erasable temperature or more. The color erasable toner contains color materials, for instance, a colorable compound, a developer, and a decolorant. If a toner image formed using the color erasable toner is heated to the given color erasable temperature or more, the colorable compound and the developer in the color erasable toner are separated, and the toner image is decolored.

The MFP 10 has a backup roller 18*a*, a driven roller 18*b*, and tension rollers 19. The backup roller 18*a*, the driven roller 18*b* and the tension rollers 19 support the intermediate transfer belt 18. The MFP 10 has multiple primary transfer rollers 28 and a secondary transfer roller 30. The primary transfer rollers 28 are disposed at positions (primary transfer positions) opposite to the photosensitive drums 22 of the image forming stations 20Y, 20M, 20C and 20K, respectively. The primary transfer rollers 28 transfer toner images of Y, M, C and K from the photosensitive drums 22 to the intermediate transfer belt 18 at the respective primary transfer positions. When the MFP 10 performs color printing, the primary transfer rollers 28 sequentially superpose the toner images of Y, M, C and K, transferring them to the intermediate transfer belt 18. The intermediate transfer belt 18 carries and rotates the toner images transferred from the photosensitive drums 22, thereby conveying the toner images to the secondary transfer roller 30. The secondary transfer roller 30 is disposed at a position (secondary transfer position) opposite to the backup roller 18*a* via the intermediate transfer belt 18. The secondary transfer roller 30 transfers the toner images carried on the intermediate transfer belt 18 to a recording medium, for instance a sheet P, conveyed to the secondary transfer position.

The MFP 10 has, in FIG. 1, a sheet feed unit 16 below the printer device 11. The sheet feed unit 16 has a sheet feed cassette 16*a* and a pickup roller 16*b*. The sheet feed cassette 16*a* contains the sheet P on which the images are printed. The sheet feed cassette 16*a* may contain, as the sheet P, an unused sheet or a used sheet. The used sheet is, for instance, a sheet in which a previously printed image is decolored by a color erasing process. The pickup roller 16*b* takes the sheets P from the sheet feed cassette 16*a* one by one, and sends it to a conveyance path 31 to be described below. The printer device 11 has a manual sheet feed tray 17 and a pickup roller 17*a*. The manual sheet feed tray 17 is mounted on a sidewall of a main body of the MFP 10 in an exposed state. The manual sheet feed tray 17 supports sheets P placed by a user. The pickup roller 17*a* takes the sheets P supported by the manual sheet feed tray 17 one by one, and sends it to the conveyance path 31 to be described below.

The printer device 11 has a conveying unit for conveying the sheets P. The conveying unit includes the conveyance path 31, resist rollers 31*a*, and sheet ejection rollers 33. The conveyance path 31 goes from the sheet feed unit 16 via the secondary transfer roller 30 and a fixing device 32 to be described below, and reaches the sheet ejection rollers 33 to be described below. The conveyance path 31 guides the sheet P sent out by the sheet feed unit 16 to the sheet ejection rollers 33 via the secondary transfer roller 30 and the fixing device 32 to be described below. The resist rollers 31*a* include a pair of rollers disposed at an upstream position relative to the secondary transfer position along the conveyance path 31 and in a direction in which the sheet P is conveyed. The resist rollers 31*a* conveys the sheet P to the secondary transfer position in accordance with conveyance timing of the toner images carried on the intermediate transfer belt 18. The sheet ejection rollers 33 include a pair of rollers disposed at an end of the conveyance path 31. The sheet ejection rollers 33 eject the sheet P on which the image is printed by fixing the toner images out of the MFP 10. The conveying unit conveys the sheet P in cooperation with the intermediate transfer belt 18, the resist rollers 31*a*, and the fixing device 32.

The scanner device 12 is provided at an upper portion of the main body of the MFP 10 in FIG. 1. The scanner device 12 obtains image data by optically scanning an image of a document. The MFP 10 may also obtain image data from the outside via a network. The printer device 11 of the MFP 10 forms the toner images on the sheet P, as described above, according to the image data. The MFP 10 has a sheet ejection tray 10*a*. The sheet ejection tray 10*a* is provided at a space portion formed between the printer device 11 and the scanner device 12 in FIG. 1. The sheet ejection tray 10*a* receives the sheet P ejected by the sheet ejection rollers 33, thereby containing the sheet P. The image forming apparatus is not limited to the MFP 10 by which the color image described above can be formed. For example, the number of image forming stations which the MFP 10 has is not limited. The image forming apparatus may be the MFP by which a monochromatic image can be formed. Further, the image forming apparatus may not be the MFP. For example, the image forming apparatus may be an apparatus having a printing function only. Further, the image forming apparatus may be configured to directly transfer the toner image from a photoreceptor to the sheet. Furthermore, the image forming apparatus may have multiple printer devices.

Figure 2:
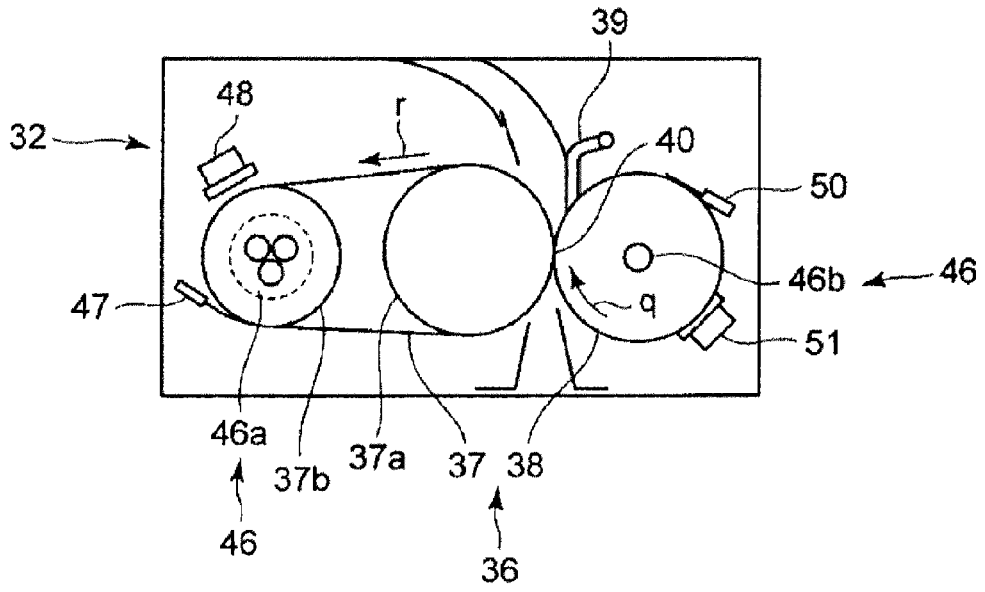
FIG. 2 is a cross-sectional view illustrating major parts of a fixing device used in the image forming apparatus according to the first embodiment.

Hereinafter, the fixing device 32 will be described with reference to FIGS. 1 and 2. As illustrated in FIG. 1, the fixing device 32 is provided at a downstream position relative to the secondary transfer position along the conveyance path 31 and in the direction in which the sheet P is conveyed. FIG. 2 is a cross-sectional view illustrating major parts of the fixing device 32. As illustrated in FIG. 2, the fixing device 32 has a fixing member 36 and a heating unit 46. The heating unit 46 heats the fixing member 36. The fixing member 36 includes, for instance, a fixing belt 37 and a pressure roller 38. The fixing belt 37 and the pressure roller 38 come into contact with each other, forming a nip 40 therebetween. The fixing member 36 clamps the sheet P in the nip 40, and conveying the sheet P. While conveying the sheet P, the fixing member 36 heats and pressurizes the toner images of the sheet P, thereby fixing the toner images to the sheet P.

The fixing belt 37 has, for instance, a rubber layer deposited with nickel (Ni) and a fluorine tube covering a surface of the rubber layer. The fixing member 36 further includes a fixing roller 37*a* and a heating roller 37*b*. The fixing belt 37 is bridged between the fixing roller 37*a* and the heating roller 37*b*. The fixing roller 37*a* is opposite to the pressure roller 38 via the fixing belt 37*a*. The heating roller 37*b* and the pressure roller 38 are rollers having, for instance, a hollow structure. The heating unit 46 has a first heater lamp 46*a* and a second heater lamp 46*b* that act as heating sources heating the fixing member 36. The first heater lamp 46*a* is provided in a hollow interior of the heating roller 46*a*. The second heater lamp 46*b* is provided in a hollow interior of the pressure roller 38. The fixing device 32 further includes a peeling claw 39 provided around the pressure roller 38.

The fixing device 32 further includes a first thermistor 47 and a first thermostat 48. The first thermistor 47 and the first thermostat 48 are provided around the fixing belt 37. The first thermistor 47 detects a temperature of the fixing belt 37. The first thermostat 48 functions as a safeguard of the fixing belt 37. The fixing device 32 further includes a second thermistor 50 and a second thermostat 51. The second thermistor 50 and the second thermostat 51 are provided around the pressure roller 38. The second thermistor 50 detects a temperature of the pressure roller 38. The second thermostat 51 functions as a safeguard of the pressure roller 38. The fixing device 32 rotates, for instance, the pressure roller 38 in a direction of an arrow q, and causes the fixing belt 37 to be rotated in a direction of an arrow r. The fixing device 32 may rotate the fixing belt 37 and the pressure roller 38 by respective separate drives.

The fixing device 32 is not limited to the aforementioned structure. For example, the fixing belt or the pressure roller that is the fixing member may be heated using an induction heating (IH) coil. Further, the fixing member 36 may be made up of a fixing roller and a pressure belt.

The CPU 100 controls a temperature of the fixing member 36 according to various control temperatures that are predetermined fixing temperature conditions. Specifically, the CPU 100 determines whether or not the fixing member 36 reaches the control temperature from a first result detected by the first thermistor 47 and a second result detected by the second thermistor 48. The CPU 100 controls a heating operation of the heating unit 46 based on the determined result. To be specific, the CPU 100 has on/off control over the heated first or second heater lamp 46*a* or 46*b* of the heating unit 46. When determining that the temperature of the fixing member 36 reaches the control temperature, the CPU 100 has on/off control over the heating unit 46, thereby holding a surface temperature of the fixing member 36 at a given temperature.

Figure 3:
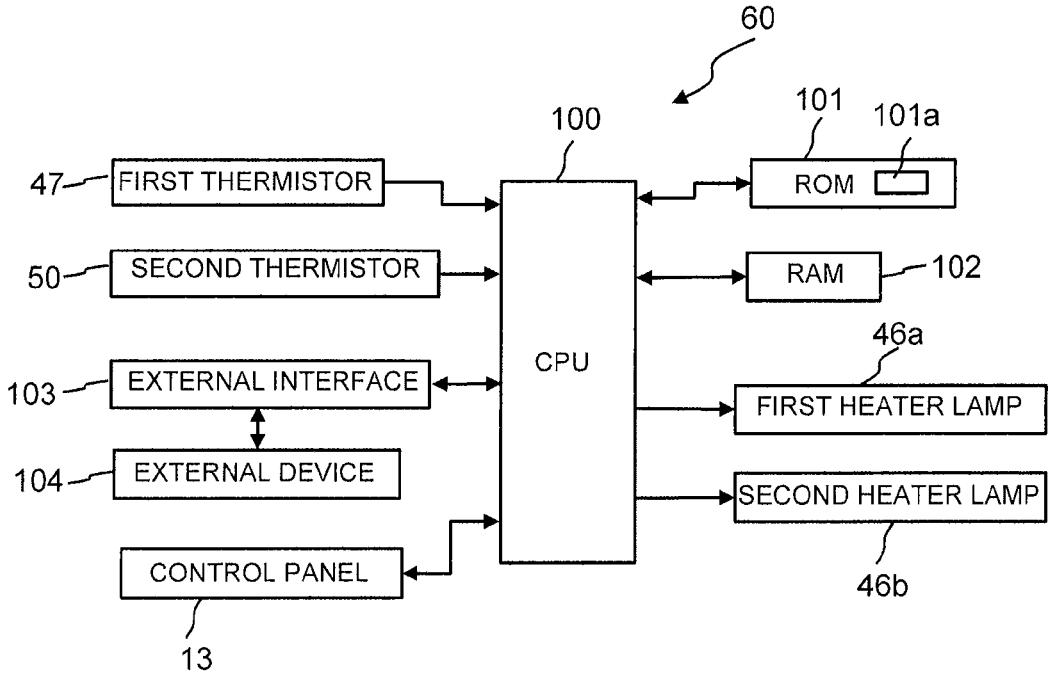
FIG. 3 is a block diagram illustrating a control system based on control of the fixing device used in the image forming apparatus according to the first embodiment.

Hereinafter, a control system 60 of the MFP 10 based on ready temperature control of the fixing device 32 will be described with reference to FIG. 3. FIG. 3 is a block diagram illustrating the control system 60 based on the control of the fixing device 32. As illustrated in FIG. 3, the control system 60 has the CPU 100 that is a control unit, and a read only memory (ROM) 101 and a random access memory (RAM) 102 that are storage units. The CPU 100 controls the entirety of the MFP 10. The CPU 100 is connected to the first thermistor 47, the second thermistor 50, the control panel 13, the first heater lamp 46*a*, and the second heater lamp 46*b*. The control panel 13 has a display unit and control buttons. The control panel 13 is an input unit by which job information of a user is input to the MFP 10 by receiving an operation of the user. The CPU 100 controls the control panel 13, the first heater lamp 46*a*, and the second heater lamp 46*b*. The CPU 100 is further connected to an external device 104 such as a personal computer (PC) via an external interface 103. The external interface 103 is an input unit by which the job information of the user is input from the external device 104 to the MFP 10.

The ROM 101 stores a control program managing a basic operation for an image forming process, and control data. The ROM 101 stores, as the control data, the control temperature of the fixing member 36. The control temperature includes a fixing reference temperature, a fixing lower limit temperature, and a ready temperature. The fixing reference temperature and the fixing lower limit temperature are temperatures of the fixing member 36 when the toner images are fixed to the sheet. The ready temperature is a temperature of the fixing member 36 when the MFP 10 is in a ready state. In other words, the ready temperature is a target temperature of the fixing member 36 when the MFP 10 returns from the sleep state to the ready state. The ROM 101 has a table 101*a* to store the ready temperature. The RAM 102 stores control parameters, the number of printing sheets, a printing time, and the like.

Hereinafter, the conditions for the ready temperature of the fixing member 36 which is previously stored in the table 101*a* of the ROM 101 will be described with reference to FIGS. 4 and 5. FIG. 4 is a view illustrating storage contents of the fixing reference temperature and the fixing lower limit temperature of the fixing device 32 (fixing member 36) which the ROM 101 stores. The ROM 101 stores the fixing reference temperature and the fixing lower limit temperature, which correspond to job conditions included in the job information of the user. FIG. 5 is a view illustrating storage contents of the ready temperature which the table 101*a* of the ROM 101 stores when the fixing reference temperature and the fixing lower limit temperature are the temperatures as illustrated in FIG. 4. The table 101*a* stores the ready temperature corresponding to the job conditions included in the job information of the user.

To be specific, as illustrated in FIG. 4, the ROM 101 uses parameters of the job conditions as a toner mode, and stores the fixing reference temperature and the fixing lower limit temperature that correspond to the parameters. The toner mode is a type of toner to be used. The toner mode includes a color mode and a monochrome mode. When the type of toner to be used is color toner, the toner mode is the color mode. When the type of toner to be used is monochromatic toner, the toner mode is the monochrome mode. The fixing reference temperature is a temperature having a margin such that poor fixing does not occur even when the MFP 10 continuously prints the maximum number of sheets. The fixing lower limit temperature is a temperature that does not cause poor fixing if the number of printing sheets is one. As illustrated in FIG. 4, the ROM 101 stores a temperature value of 160° C. as the fixing reference temperature when the toner mode is the color mode. Further, the ROM 101 stores a temperature value of 150° C. as the fixing lower limit temperature when the toner mode is the color mode. Thus, when the MFP 10 fixes the toner images made of, for instance, the color toner, the CPU 100 controls the temperature of the fixing member 36 using the fixing reference temperature as 160° C. and using the fixing lower limit temperature as 150° C. Further, the ROM 101 stores a temperature value of 140° C. as the fixing reference temperature when the toner mode is the monochrome mode. Further, the ROM 101 stores a temperature value of 130° C. as the fixing lower limit temperature when the toner mode is the monochrome mode. Thus, when the MFP 10 fixes the toner images made of, for instance, the monochromatic toner, the CPU 100 controls the temperature of the fixing member 36 using the fixing reference temperature as 140° C. and using the fixing lower limit temperature as 130° C.

The table 101*a* of the ROM 101 uses the parameters of the job conditions as the number of printing sheets and the toner mode, and stores the ready temperature conditions corresponding to these parameters. The ready temperature conditions include multiple ready temperatures. Specifically, as illustrated in FIG. 5, the table 101*a* stores, for instance, a temperature value of 150° C. as the ready temperature when the toner mode is the color mode and when the number of printing sheets is one. The table 101*a* stores, for instance, a temperature value of 152° C. as the ready temperature when the toner mode is the color mode and when the number of printing sheets is not less than two and not more than five. The table 101*a* stores, for instance, a temperature value of 155° C. as the ready temperature when the toner mode is the color mode and when the number of printing sheets is not less than six and not more than ten. The table 101*a* stores, for instance, a temperature value of 160° C. as the ready temperature when the toner mode is the color mode and when the number of printing sheets is not less than eleven.

Further, as illustrated in FIG. 5, the table 101*a* stores, for instance, a temperature value of 130° C. as the ready temperature when the toner mode is the monochrome mode and when the number of printing sheets is one. The table 101*a* stores, for instance, a temperature value of 132° C. as the ready temperature when the toner mode is the monochrome mode and when the number of printing sheets is not less than two and not more than five. The table 101*a* stores, for instance, a temperature value of 135° C. as the ready temperature when the toner mode is the monochrome mode and when the number of printing sheets is not less than six and not more than ten. The table 101*a* stores, for instance, a temperature value of 140° C. as the ready temperature when the toner mode is the monochrome mode and when the number of printing sheets is not less than eleven.

The MFP 10 returns from the sleep state to the ready state based on the ready temperature corresponding to printing job information input by a user among the ready temperatures stored in the table 101*a*. Accordingly, when the MFP 10 returns to the ready state and conducts print, even the final sheet P can be printed without occurrence of the poor fixing.

Figure 6:
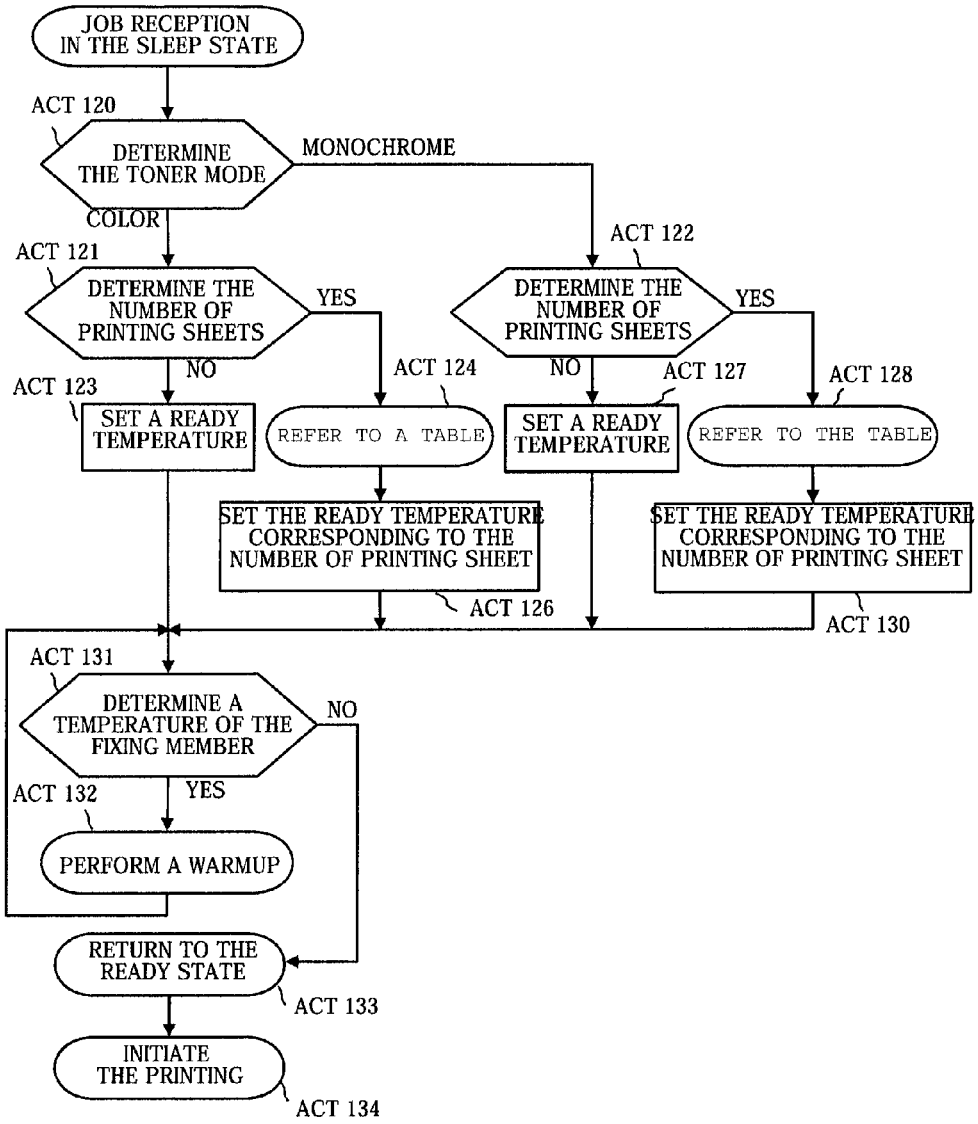
FIG. 6 is a flow chart illustrating a process of returning from a sleep state to a ready state in the image forming apparatus according to the first embodiment.

When the control panel 13 receives the job information that is input by a user and is associated with the printing during a period of the sleep state, the MFP 10 returns from the sleep state to the ready state. Further, when the external device 104 connected to the MFP 10 receives the job information that is input by a user and is associated with the printing during a period of the sleep state, the MFP 10 returns from the sleep state to the ready state. Hereinafter, the process of the MFP 10 returning from the sleep state to the ready state when the MFP 10 initiates the printing in response to the user's input of the job information associated with the printing from the control panel 13 or the external device during a period for which the MFP 10 is in the sleep state will be described with reference to FIG. 6. FIG. 6 is a flow chart illustrating the process of returning from the sleep state to the ready state in the MFP 10. As illustrated in FIG. 6, for example, when the control panel 13 receives input of the job information from a user, the CPU 100 determines from the job information whether a toner mode is a color mode or a monochrome mode in ACT 120. When the CPU 100 determines that the print mode is the color mode, the controlling process of the CPU 100 proceeds to ACT 121. When the CPU 100 determines that the print mode is the monochrome mode, the controlling process of the CPU 100 proceeds to ACT 122.

In ACT 121, the CPU 100 determines from the job information whether or not the number of printing sheets is equal to or more than two in the color mode. When the CPU 100 determines that the number of printing sheets is not equal to or more than two (when the number of printing sheets is one), the controlling process of the CPU 100 proceeds to ACT 123. In ACT 123, the CPU 100 refers to the storage contents of the table 101*a* illustrated in FIG. 5, thereby setting the ready temperature to 150° C. in a ready state when causing the MFP 10 to return from a sleep state to the ready state. In ACT 121, when the CPU 100 determines that the number of printing sheets is equal to or more than two (when the number of printing sheets is multiple), the controlling process of the CPU 100 proceeds to ACT 124. In ACT 124, the CPU 100 refers to the storage contents of the table 101*a* illustrated in FIG. 5, and selects a temperature corresponding to the number of printing sheets when the toner mode is the color mode. In ACT 126, depending on the selected result, the CPU 100 sets the ready temperature in the ready state when causing the MFP 10 to return from the sleep state to the ready state to the temperature corresponding to the number of printing sheets when the toner mode is the color mode.

On the other hand, in ACT 122, the CPU 100 determines from the job information whether or not the number of printing sheets is equal to or more than two in a monochrome mode. In ACT 122, when the CPU 100 determines that the number of printing sheets is not equal to or more than two (when the number of printing sheets is one), the controlling process of the CPU 100 proceeds to ACT 127. In ACT 127, the CPU 100 refers to the storage contents of the table 101*a* illustrated in FIG. 5, thereby setting the ready temperature when causing the MFP 10 to return from the sleep state to the ready state to 130° C. In ACT 122, when the CPU 100 determines that the number of printing sheets is equal to or more than two (when the number of printing sheets is multiple), the controlling process of the CPU 100 proceeds to ACT 128. In ACT 128, the CPU 100 refers to the storage contents of the table 101*a* illustrated in FIG. 5, and selects a temperature corresponding to the number of printing sheets when the toner mode is the monochrome mode. In ACT 130, depending on the selected result, the CPU 100 sets the ready temperature when causing the MFP 10 to return from the sleep state to the ready state to the temperature corresponding to the number of printing sheets when the toner mode is the monochrome mode.

In ACT 123, ACT 126, ACT 127 or ACT 130, if the CPU 100 sets the ready temperature when causing the MFP 10 to return from the sleep state to the ready state, the controlling process of the CPU 100 proceeds to ACT 131. In ACT 131, the CPU 100 determines from the results of the detection of the first and second thermistors 47 and 48 whether or not the temperature of the fixing member 36 is equal to or less than the ready temperature. In ACT 131, when the CPU 100 determines that the temperature of the fixing member 36 is equal to or less than the ready temperature, the controlling process of the CPU 100 proceeds to ACT 132. In ACT 132, the CPU 100 warms up the MFP 10. Specifically, the CPU 100 controls the first and second heater lamps 46*a* and 46*b* such that the temperature of the fixing member 36 is higher than the ready temperature. The CPU 100 repeats the processes of ACT 131 and ACT 132 until the temperature of the fixing member 36 is higher than the ready temperature.

In ACT 131, when the CPU 100 determines that the temperature of the fixing member 36 is not equal to or less than the ready temperature (when the temperature of the fixing member 36 is higher than the ready temperature), the controlling process of the CPU 100 proceeds to ACT 133. In ACT 133, the CPU 100 causes the MFP 10 to return from the sleep state to the ready state. In ACT 134, the CPU 100 causes the MFP 10 of the ready state to initiate the printing according to the job information.

As described above, when returning from the sleep state to the ready state, the MFP 10 changes the ready temperature according to the job information input by the user. Thus, when a load on the fixing device 32 is small such as when the number of printing sheets is small, the MFP 10 can reduce the time required for a warmup (W/U). Hereinafter, the warmup time when the MFP 10 returns from the sleep state to the ready state will be described with reference to FIGS. 7 and 8.

Figure 7A:
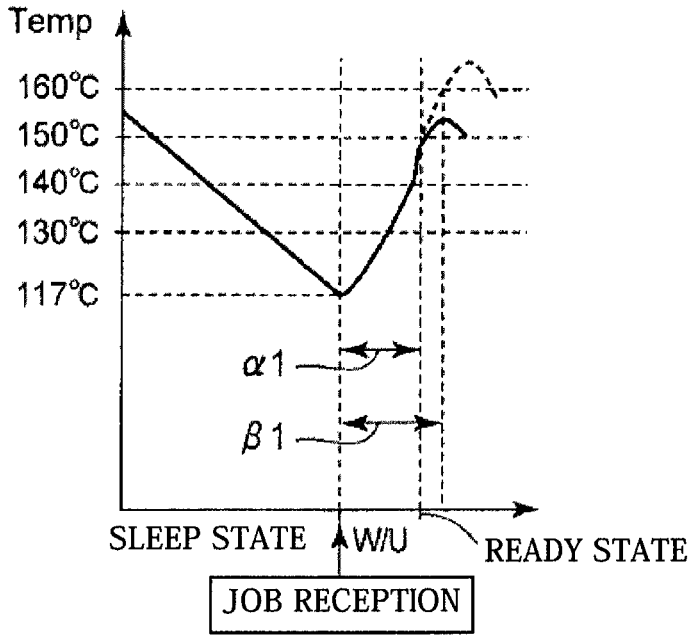
FIG. 7A is a graph illustrating a warmup time required to return from the sleep state to the ready state in order to print one sheet in color when a temperature of the fixing device during the sleep state is 117° C. in the image forming apparatus according to the first embodiment.

FIG. 7A is a graph illustrating a warmup time when the MFP 10 returns from a sleep state to a ready state in order to print one sheet in color when a temperature of the fixing member 36 of the fixing device 32 during the sleep state is 117° C. The vertical axis of the graph of FIG. 7A indicates the temperature of the fixing member 36, and the horizontal axis indicates the operation state of the MFP 10. For example, a ready temperature when the toner mode is the color mode and when the MFP 10 receives job information about one printing sheet is 150° C. as illustrated in FIG. 5. Thus, the CPU 100 sets the ready temperature to 150° C. according to the job information. When the temperature of the fixing member 36 rises from 117° C. to 150° C. by performing a warmup, the MFP 10 returns from the sleep state to the ready state. As illustrated in FIG. 7A, when the temperature of the fixing member 36 during the sleep state is 117° C., if the MFP 10 receives input of the job information from a user (job reception), the MFP 10 becomes the ready state after a warmup time $\alpha 1$. In contrast, when 160° C. (see FIG. 4) that is a fixing reference temperature, for instance, in the case of the color mode is set as the ready temperature, the warmup time requires $\beta 1$ ($>\alpha 1$) as illustrated in FIG. 7A. Thus, the MFP 10 sets the ready temperature to 150° C. according to the job information, and can thereby reduce the warmup time.

Figure 7B:
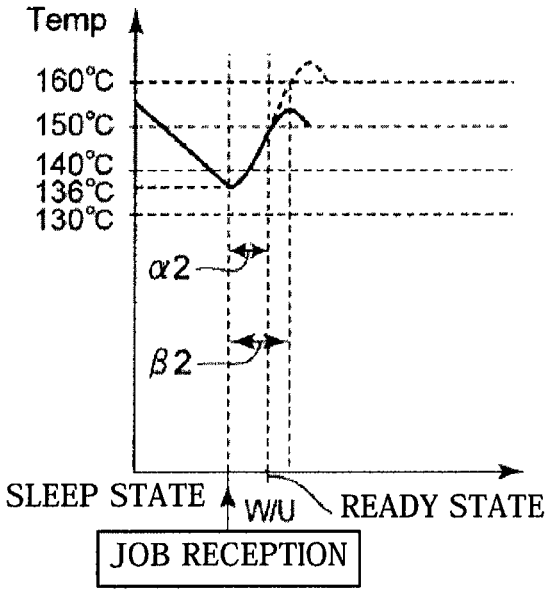
FIG. 7B is a graph illustrating a warmup time required to return from the sleep state to the ready state in order to print one sheet in color when a temperature of the fixing device during the sleep state is 136° C. in the image forming apparatus according to the first embodiment.

FIG. 7B is a graph illustrating a warmup time when the MFP 10 returns from a sleep state to a ready state in order to print one sheet in color when a temperature of the fixing member 36 of the fixing device 32 during the sleep state is 136° C. The vertical axis of the graph of FIG. 7B indicates the temperature of the fixing member 36, and the horizontal axis indicates the operation state of the MFP 10. For example, a ready temperature when the toner mode is the color mode and when the MFP 10 receives job information about one printing sheet is 150° C. (see FIG. 5). Thus, the CPU 100 sets the ready temperature to 150° C. according to the job information. When the temperature of the fixing member 36 rises from 136° C. to 150° C. by performing a warmup, the MFP 10 returns from the sleep state to the ready state. As illustrated in FIG. 7B, when the temperature of the fixing member 36 during the sleep state is 136° C., if the MFP 10 receives input of the job information from a user, the MFP 10 becomes the ready state after a warmup time $\alpha 2$. In contrast, when 160° C. (see FIG. 4) that is a fixing reference temperature, for instance, in the case of the color mode is set as the ready temperature, the warmup time requires $\beta 2$ ($>\alpha 2$) as illustrated in FIG. 7B. Thus, the MFP 10 sets the ready temperature to 150° C. according to the job information, and can thereby reduce the warmup time.

Figure 8A:
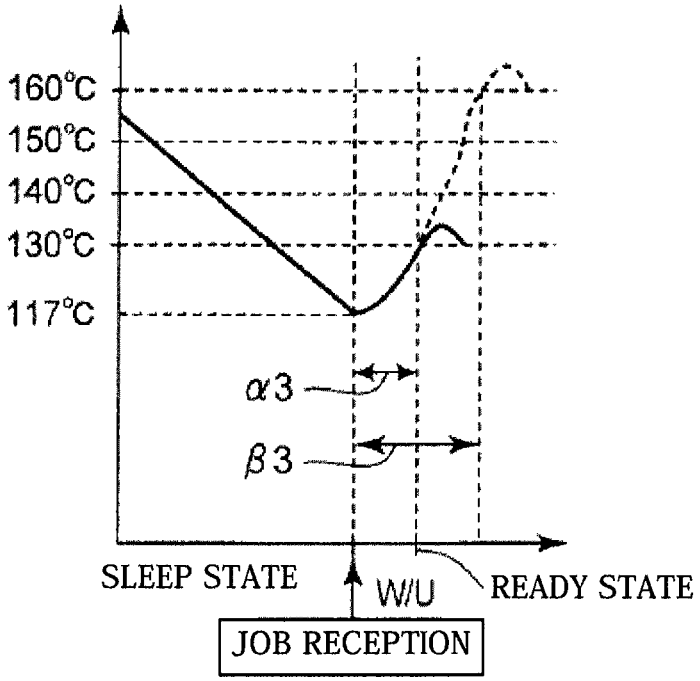
FIG. 8A is a graph illustrating a warmup time required to return from the sleep state to the ready state in order to print one sheet in monochrome when a temperature of the fixing device during the sleep state is 117° C. in the image forming apparatus according to the first embodiment.

FIG. 8A is a graph illustrating a warmup time when the MFP 10 returns from a sleep state to a ready state in order to print one sheet in monochrome when a temperature of the fixing member 36 of the fixing device 32 during the sleep state is 117° C. The vertical axis of the graph of FIG. 8A indicates the temperature of the fixing member 36, and the horizontal axis indicates the operation state of the MFP 10. For example, a ready temperature when the toner mode is the monochrome mode and when the MFP 10 receives job information about one printing sheet is 130° C. as illustrated in FIG. 5. Thus, the CPU 100 sets the ready temperature to 130° C. according to the job information. When the temperature of the fixing member 36 rises from 117° C. to 130° C. by performing a warmup, the MFP 10 returns from the sleep state to the ready state. As illustrated in FIG. 8A, when the temperature of the fixing member 36 during the sleep state is 117° C., if the MFP 10 receives input of the job information from a user, the MFP 10 becomes the ready state after a warmup time $\alpha 3$. In contrast, when 160° C. (see FIG. 4) that is a fixing reference temperature, for instance, in the case of the color mode is set as the ready temperature, the warmup time requires $\beta 3$ ($>\alpha 3$) as illustrated in FIG. 8A. Thus, the MFP 10 sets the ready temperature to 130° C. according to the job information, and can thereby reduce the warmup time.

Figure 8B:
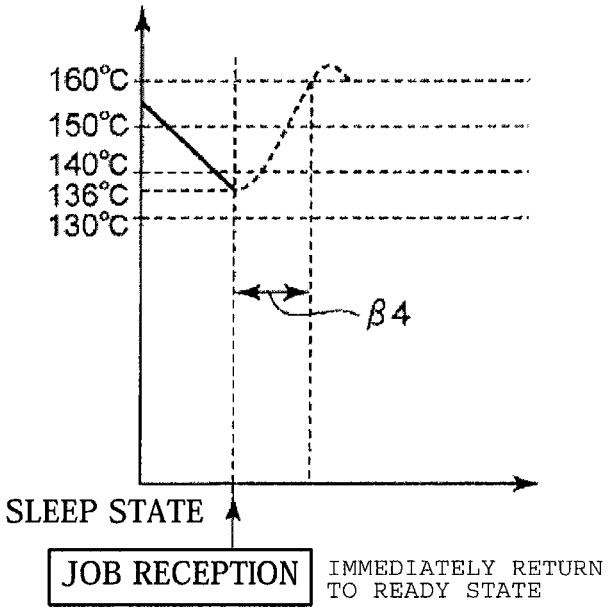
FIG. 8B is a graph illustrating a warmup time required to return from the sleep state to the ready state in order to print one sheet in monochrome when a temperature of the fixing device during the sleep state is 136° C. in the image forming apparatus according to the first embodiment.

FIG. 8B is a graph illustrating a warmup time when the MFP 10 returns from a sleep state to a ready state in order to print one sheet in monochrome when a temperature of the fixing member 36 of the fixing device 32 during the sleep state is 136° C. The vertical axis of the graph of FIG. 8B indicates the temperature of the fixing member 36, and the horizontal axis indicates the operation state of the MFP 10. For example, a ready temperature when the toner mode is the monochrome mode and when the MFP 10 receives job information about one printing sheet is 130° C. as illustrated in FIG. 5. Thus, the CPU 100 sets the ready temperature to 130° C. according to the job information. Since the temperature of the fixing member 36 is 136° C., the MFP 10 need not perform a warmup, and immediately returns from the sleep state to the ready state. In contrast, when 160° C. that is a fixing reference temperature, for instance, in the case of the color mode is set as the ready temperature, the warmup time requires β4. Thus, the MFP 10 sets the ready temperature to 130° C. according to the job information, and can thereby reduce the warmup time.

Even when the MFP 10 receives the job information in which the number of printing sheets is equal to or less than ten, the ready temperature when the MFP 10 returns from the sleep state to the ready state is set to be lower than the fixing reference temperature like the foregoing. Thus, the MFP 10 can reduce the warmup time.

According to the first embodiment, the MFP 10 stores the multiple ready temperatures, which correspond to the job conditions using the number of printing sheets and the toner mode as the parameters, in the table 101*a*. The CPU 100 selects and sets the ready temperature when MFP 10 returns from the sleep state to the ready state from the table 101*a* according to the job conditions included in the printing job information input by the user. The MFP 10 returns from the sleep state to the ready state at the ready temperature corresponding to the job information of the user. Thus, a time required for the warmup in returning from the sleep state to the ready state can be reduced. Further, according to the first embodiment, due to the reduction of the warmup time, it is possible to improve operability of the MFP 10 and to save consumption energy.

Figure 10:
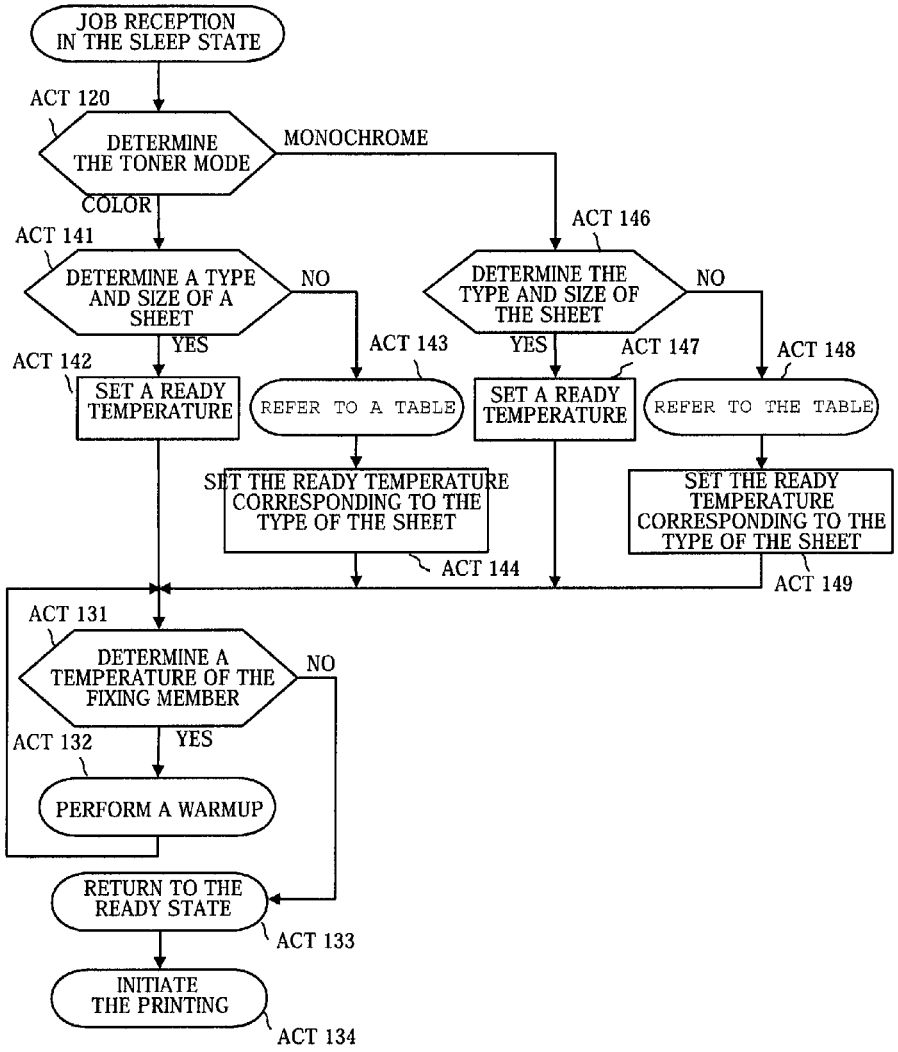
FIG. 10 is a flow chart illustrating a process of returning from a sleep state to a ready state in the image forming apparatus according to the second embodiment.

Hereinafter, an MFP 10 according to a second embodiment will be described with reference to FIGS. 9 and 10. The second embodiment and the first embodiment differ in the parameters of the job conditions. The parameters of the job conditions in the MFP 10 according to the second embodiment are, for instance, a sheet type and a toner mode. The MFP 10 stores multiple ready temperatures corresponding to the parameters in a table 101*a*. In the MFP 10 according to the second embodiment, the same components as described in the first embodiment above are given the same reference numerals, and detailed description thereof will be omitted.

FIG. 9 is a view illustrating storage contents of ready temperatures which the table 101*a* of a ROM 101 stores. The table 101*a* stores the ready temperatures corresponding to job conditions included in job information of a user. The table 101*a* uses the parameters of the job conditions included in the job information of the user as the sheet type and the toner mode, and stores ready temperature conditions corresponding to these parameters. The ready temperature conditions include multiple ready temperatures. To be specific, as illustrated in FIG. 9, the table 101*a* stores, for instance, a temperature value of 150° C. as the ready temperature condition when the toner mode is a color mode and the type of the sheet P is a plain sheet having a size of A4. The table 101*a* stores, for instance, a temperature value of 152° C. as the ready temperature condition when the toner mode is a color mode and the type of the sheet P is a plain sheet having a size of A3. The table 101*a* stores, for instance, a temperature value of 155° C. as the ready temperature condition when the toner mode is a color mode and the type of the sheet P is a thick sheet having the A4 size. The table 101*a* stores, for instance, a temperature value of 160° C. as the ready temperature condition when the toner mode is a color mode and the type of the sheet P is a thick sheet having the A3 size.

Further, as illustrated in FIG. 9, the table 101*a* stores, for instance, a temperature value of 130° C. as the ready temperature condition when the toner mode is a monochrome mode and the type of the sheet P is a plain sheet having the A4 size. The table 101*a* stores, for instance, a temperature value of 132° C. as the ready temperature condition when the toner mode is a monochrome mode and the type of the sheet P is a plain sheet having the A3 size. The table 101*a* stores, for instance, a temperature value of 135° C. as the ready temperature condition when the toner mode is a monochrome mode and the type of the sheet P is a thick sheet having the A4 size. The table 101*a* stores, for instance, a temperature value of 140° C. as the ready temperature condition when the toner mode is a monochrome mode and the type of the sheet P is a thick sheet having the A3 size.

The MFP 10 returns from the sleep state to the ready state when a control panel 13 receives the job information that is input by a user and is associated with the printing during a period of the sleep state. Further, the MFP 10 returns from the sleep state to the ready state when an external device 104 connected to the MFP 10 receives the job information that is input by a user and is associated with the printing during a period of the sleep state. Hereinafter, the process of the MFP 10 returning from the sleep state to the ready state when the MFP 10 initiates the printing in response to the user's input of the job information associated with the printing from the control panel 13 or the external device during a period during which the MFP 10 is in the sleep state will be described with reference to FIG. 10. FIG. 10 is a flow chart illustrating the process of returning from the sleep state in the MFP 10. As illustrated in FIG. 10, for example, when the control panel 13 receives input of the job information from a user during a period during which the MFP 10 is in the sleep state, the CPU 100 determines from the job information whether a toner mode is a color mode or a monochrome mode in ACT 120. When the CPU 100 determines that the toner mode is the color mode, the controlling process of the CPU 100 proceeds to ACT 141. When the CPU 100 determines that the print mode is the monochrome mode, the controlling process of the CPU 100 proceeds to ACT 146.

In ACT 141, the CPU 100 determines from the job information whether or not a type of a sheet P is a plain sheet having a size of A4 in a color mode. When the CPU 100 determines that the type of the sheet P is the plain sheet having the A4 size, the controlling process of the CPU 100 proceeds to ACT 142. In ACT 142, the CPU 100 refers to the storage contents of the table 101*a* illustrated in FIG. 9, thereby setting a ready temperature in the ready state when causing the MFP 10 to return from the sleep state to the ready state to 150° C. In ACT 141, when the CPU 100 determines that the type of the sheet P is not the plain sheet having the A4 size, the controlling process of the CPU 100 proceeds to ACT 143. In ACT 143, the CPU 100 refers to the storage contents of the table 101*a* illustrated in FIG. 9, and selects a temperature corresponding to the type of the sheet P when the toner mode is the color mode. In ACT 144, depending on the selected result, the CPU 100 sets the ready temperature in the ready state when causing the MFP 10 to return from the sleep state to the ready state to the temperature corresponding to the type of the sheet P when the toner mode is the color mode.

On the other hand, in ACT 146, the CPU 100 determines from the job information whether or not the type of the sheet P is a plain sheet having a size of A4 in a monochrome mode. In ACT 146, when the CPU 100 determines that the type of the sheet P is the plain sheet having the A4 size, the controlling process of the CPU 100 proceeds to ACT 147. In ACT 147, the CPU 100 refers to the storage contents of the table 101*a* illustrated in FIG. 9, and sets the ready temperature in the ready state when causing the MFP 10 to return from the sleep state to the ready state to 130° C. In ACT 146, when the CPU 100 determines that the type of the sheet P is not the plain sheet having the A4 size, the controlling process of the CPU 100 proceeds to ACT 148. In ACT 148, the CPU 100 refers to the storage contents of the table 101*a* illustrated in FIG. 9, and selects a temperature corresponding to the type of the sheet P when the toner mode is the monochrome mode. In ACT 149, depending on the selected result, the CPU 100 sets the ready temperature in the ready state when causing the MFP 10 to return from the sleep state to the ready state to the temperature corresponding to the type of the sheet P when the toner mode is the monochrome mode.

In ACT 142, ACT 144, ACT 147 or ACT 149, the CPU 100 sets the ready temperature when causing the MFP 10 to return from the sleep state to the ready state, and then performs processes of ACT 131 to ACT 134 as in the first embodiment. The CPU 100 performs ACT 131 to ACT 134, thereby initiating the printing according to the job information input by the user (ACT 134).

According to the second embodiment, the MFP 10 stores the ready temperature conditions, which correspond to the job conditions using the toner mode and the sheet type as the parameters, in the table 101*a*. The CPU 100 selects and sets the ready temperature when the MFP 10 returns from the sleep state to the ready state from the table 101*a* according to the printing job information input by the user. Like the first embodiment, the MFP 10 returns from the sleep state to the ready state at the ready temperature corresponding to the job information of the user. Accordingly, it is possible to reduce the time required for the warmup in returning from the sleep state to the ready state. Further, according to the second embodiment, as in the first embodiment, due to the reduction of the warmup time, it is possible to improve the operability of the MFP 10 and to save the consumption energy.

According to at least one of the embodiments described above, it is possible to reduce the time required for the warmup when the image forming apparatus is caused to return from the sleep state to the ready state. Further, according to the embodiments, it is possible to improve the operability of the image forming apparatus and to save the consumption energy.

The aforementioned embodiments are not limited to the aforementioned configurations, and may be variously modified. For example, the parameters of the job conditions may be things other than the toner mode, the number of printing sheets, and the sheet type. Further, the fixing reference temperature or the fixing lower limit temperature of the fixing member is optional depending on a type of the image forming apparatus.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus for forming an image on a recording medium, the image forming apparatus comprising:

a fixing member configured to fix a toner image to the recording medium;

a heating unit configured to heat the fixing member;

an input unit configured to receive a print job, the print job indicating a print mode and at least one job condition; and a control unit configured to:

control the image forming apparatus in a sleep state and in a ready state, if the input unit receives the print job when the image forming apparatus is in the sleep state, determine a ready temperature based on the print mode and the at least one job condition indicated in the print job, and control a heating operation of the heating unit based on the determined ready temperature to change the image forming apparatus from the sleep state to the ready state.

2. The image forming apparatus according to claim 1, wherein the control unit controls the heating operation of the heating unit such that a temperature of the fixing member becomes the ready temperature when the image forming apparatus changes from the sleep state to the ready state.

3. The image forming apparatus according to claim 1, further comprising a memory storing multiple ready temperatures.

4. The image forming apparatus according to claim 3, wherein the memory stores the multiple ready temperatures corresponding to different print modes and job conditions.

5. The image forming apparatus according to claim 3, wherein the ready temperature is stored as a function of the print mode and the at least one job condition.

6. The image forming apparatus according to claim 4, wherein the control unit determines the ready temperature to be one of the stored multiple ready temperatures.

7. The image forming apparatus according to claim 1, wherein the control unit causes the image forming apparatus to return from the sleep state to the ready state when the fixing member reaches the determined ready temperature.

8. The image forming apparatus according to claim 1, wherein the at least one job condition includes at least one of: a number of recording mediums required to form the image, a size of the recording medium, and a type of the recording medium.

9. The image forming apparatus according to claim 1, wherein the print mode is one of a color image forming mode and a monochrome image forming mode.

10. The image forming apparatus according to claim 1, wherein the input unit is further configured to receive the print job before the image forming apparatus changes from the sleep state to the ready state.

11. An image forming method comprising:

receiving a print job in an image forming apparatus, the print job indicating a print mode and at least one job condition;

controlling the image forming apparatus in a sleep state and a ready state;

when the print job is received in the sleep state, determining a ready temperature of a fixing member of the image forming apparatus based on the print mode and the at least one job condition indicated in the print job; and controlling a heating operation of the fixing member based on the determined ready temperature to change the image forming apparatus from the sleep state to the ready state.

12. The image forming method according to claim 11, wherein the print mode is one of a color image forming mode and a monochrome image forming mode.

13. The image forming method according to claim 11, wherein the controlling of the heating operation includes causing the image forming apparatus to return from the sleep state to the ready state when a temperature of the fixing member reaches the determined ready temperature to fix a toner image to a recording medium.

* * * * *